United States Patent [19]

Horn et al.

[11] 4,158,303

[45] Jun. 19, 1979

[54] FRAME AND BODY STRAIGHTENING EQUIPMENT

[76] Inventors: Cyrill Horn; Wayne J. Horn, both of Rte. 5, Box 49, Corinth, Miss. 38834

[21] Appl. No.: 836,797

[22] Filed: Sep. 26, 1977

Related U.S. Application Data

[63] Continuation of Ser. No. 642,200, Dec. 18, 1975, abandoned.

[51] Int. Cl.[2] ..... B21D 1/14

[52] U.S. Cl. ..... 72/457; 72/705

[58] Field of Search ..... 72/705, 457

[56] References Cited

U.S. PATENT DOCUMENTS

| | | | |
|---|---|---|---|
| 2,442,425 | 6/1948 | Merrill et al. | 72/705 |
| 3,566,666 | 3/1971 | Berendt | 72/705 |
| 3,888,100 | 6/1975 | Chisum | 72/705 |
| 4,023,394 | 5/1977 | Borup | 72/705 |

FOREIGN PATENT DOCUMENTS

| | | | |
|---|---|---|---|
| 2227849 | 12/1973 | Fed. Rep. of Germany | 72/705 |
| 1323163 | 7/1973 | United Kingdom | 72/705 |

*Primary Examiner*—C. W. Lanham
*Assistant Examiner*—D. M. Gurley
*Attorney, Agent, or Firm*—Frank P. Cyr

[57] ABSTRACT

Improvement in an apparatus designed to be employed in the straightening of a damaged vehicle frame or the like wherein a vertically extending tower having pulling members mounted thereon and a rotatally mounted framework for supporting a vehicle frame to be straightened is employed and can be adjusted in a desired position whereby when a pulling force is exerted on the said frame by means of the aforesaid pulling the bent or otherwise damaged portion of the frame may be restored to it's original unbent condition.

3 Claims, 5 Drawing Figures

FIG. 1
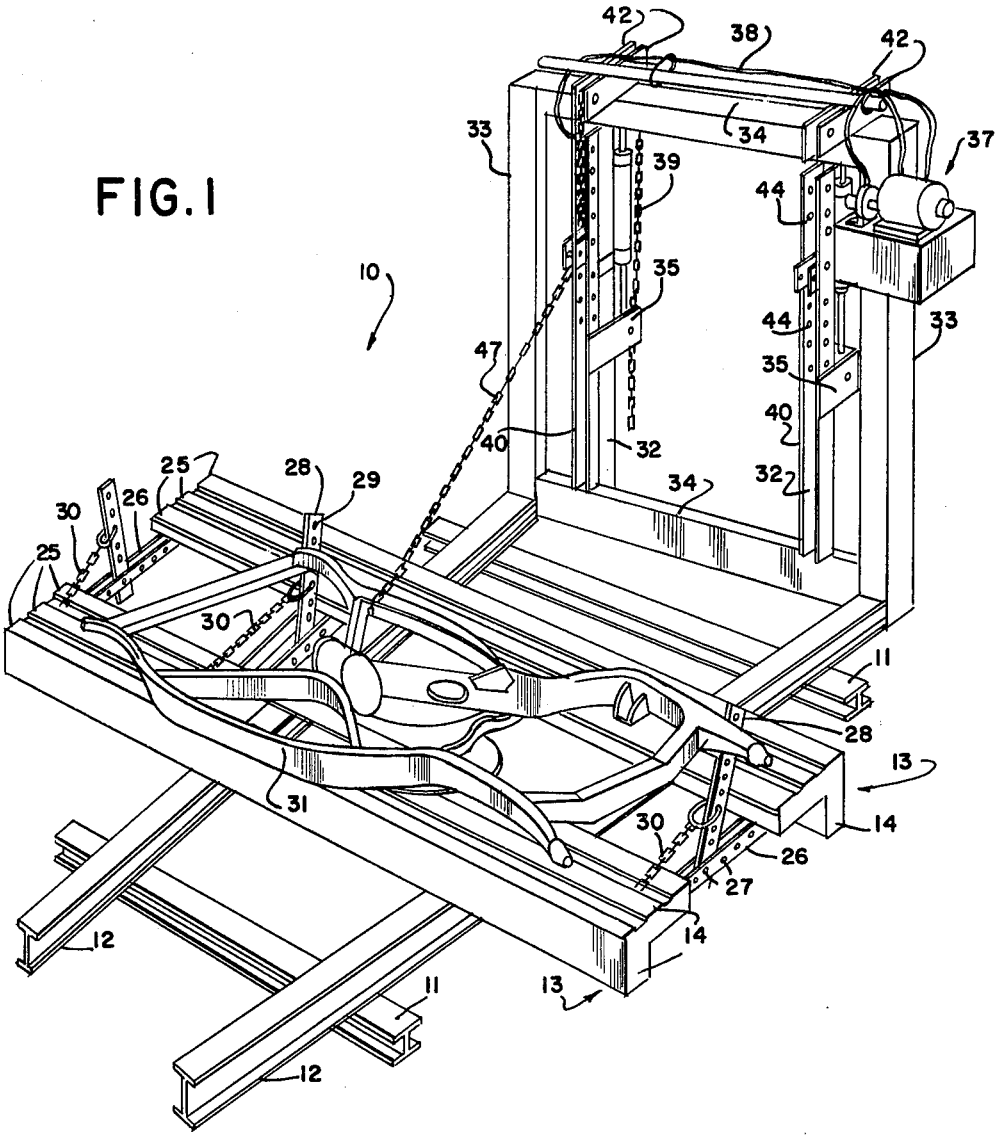
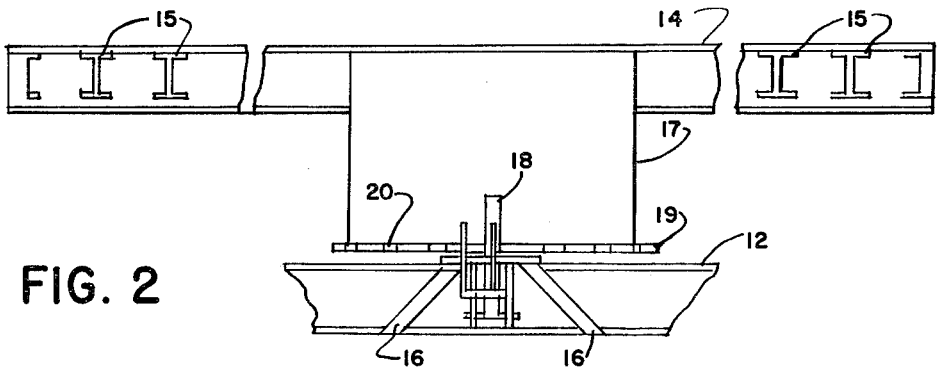
FIG. 2

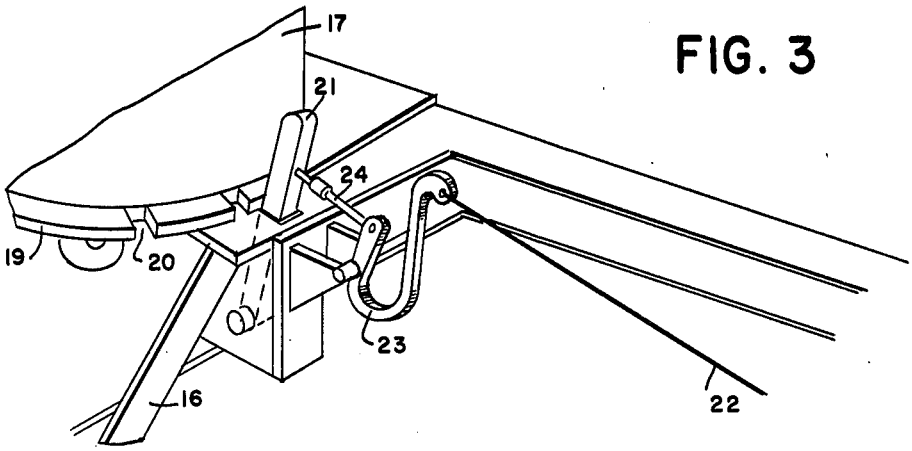
FIG. 3
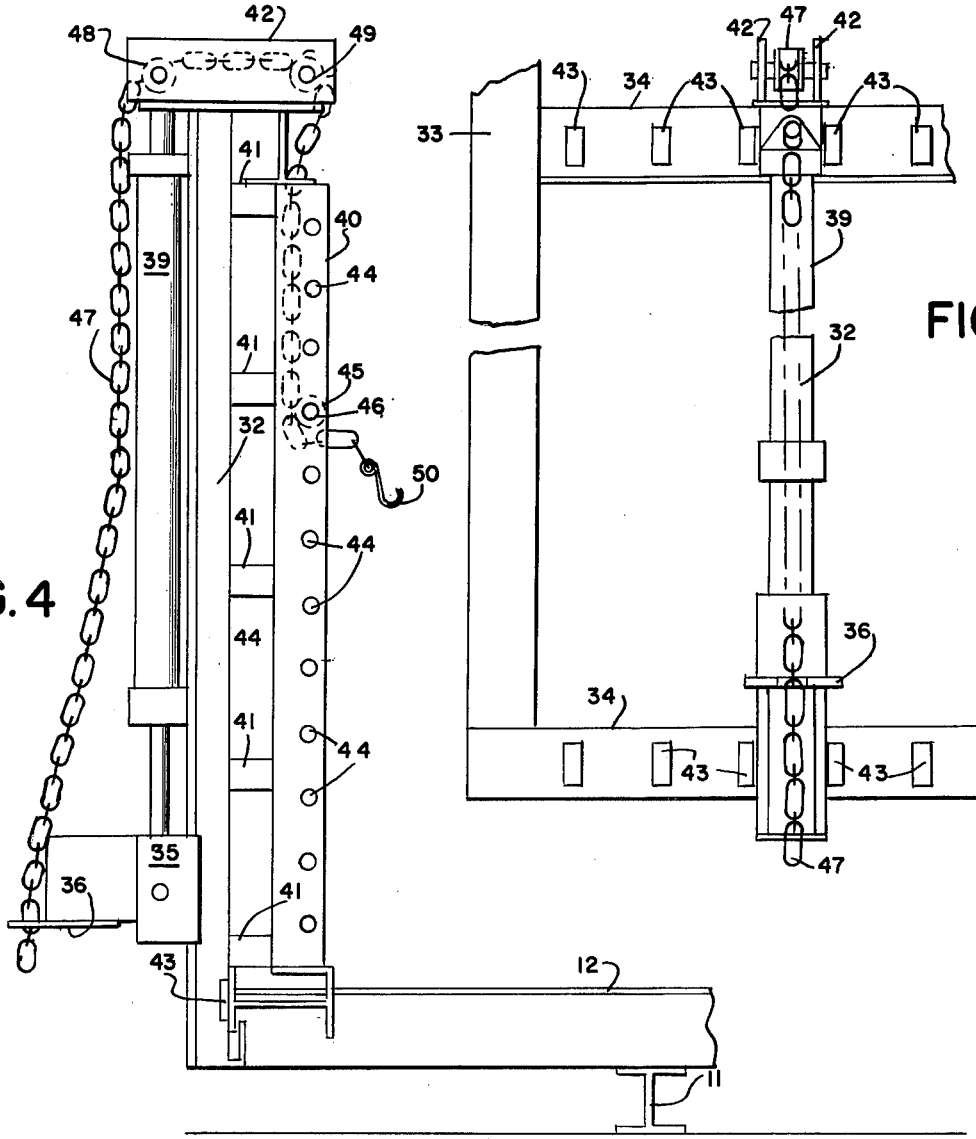
FIG. 4
FIG. 5

FRAME AND BODY STRAIGHTENING EQUIPMENT

CROSS-REFERENCE TO RELATED APPLICATION

This application is a continuation of application Ser. No. 642,200 filed Dec. 18, 1975, now abandoned.

BACKGROUND OF THE INVENTION

In the repair of automobile frames or the like which have been damaged due to accidents, or the like, it is essential that the frame of the vehicle be restored to its original condition as otherwise any repair done to the body of the vehicle will serve only to restore the body portion to its original condition and if the vehicle frame has not been restored to its original condition, such body repair work will be in vain insofar as rendering the vehicle safe for travel. As can be appreciated, if the frame of the vehicle has not been restored to its original condition, it will be virtually impossible to align the wheels of the vehicle thus resulting in a vehicle which will either pull to the left or to the right during travel thereof, and, even at a moderate rate of speed of the vehicle, the operator thereof will encounter difficulties in maintaining the desired direction of travel, thus contributing to the cause of an accident. Also, in devices employed in the past for straightening a bent vehicle frame, complex devices have been used to straighten a bent portion of a frame and such prior devices, due to their structural shortcomings, have not proven to be entirely satisfactory.

Thus, with the above in mind, it is the primary object of the invention to provide a simple yet very effective structure capable of straightening the bent portion of a vehicle frame with relative ease and with a minimum number of man hours required to effect such frame straightening.

Another object of the invention is to provide a vertically extending framework with power means mounted thereon, said power means capable of being shifted along said vertically extending framework to thus enable the operator of the frame straightener to apply a pulling force at the exact location on the frame where such pulling force is to be applied in order to straighten a bent frame.

Another object of the invention is to provide an adjustable base upon which a bent vehicle frame is mounted and secured thereto and retained thereon during the application of the pull forces for straightening the bent frame.

Another object of the invention is to provide an efficient means for locking the adjustable base in the desired position so that when a pulling force is exerted on the bent vehicle frame mounted thereon, the angle of such pulling force on the bent frame will be such as to straighten out the bent portion of the frame.

Another object of the invention is to mount a pair of hydraulic or pneumatic power cylinders on vertically extending and laterally adjustable standards which are mounted on a generally rectangularly shaped support tower which is rigidly secured at the lower end thereof to a suitable framework extending along a supporting surface such as the floor of a garage, or, in instances where the straightening equipment is exteriorly of a garage, the framework may be ground supported.

The many advantages of the invention will be more readily apparent and appreciated as the same becomes understood by reference to the following detailed description which is to be considered in connection with the accompanying drawings wherein like reference characters designate like parts throughout the several figures thereof.

BRIEF DESCRIPTION OF THE DRAWINGS

FIG. 1 is a perspective view showing the manner in which a pulling force is applied to a vehicle frame mounted on an adjustable base.

FIG. 2 is a sectional view with parts broken away showing the rotatable drum on which is mounted the adjustable base.

FIG. 3 is an enlarged sectional view showing the manner of locking the rotatable drum in the desired position.

FIG. 4 is a side elevational view showing the power cylinder and associated parts mounted on the laterally adjustable standards, and, FIG. 5 is an enlarged view with parts broken away showing the manner in which the laterally adjustable standards may be retained in their adjusted position.

DESCRIPTION OF THE PREFERRED EMBODIMENTS

Referring now to FIG. 1 of the drawings, numeral 10 designates generally a vehicle frame straightening apparatus constructe in accordance with the present invention. A pair of spaced apart I-beams 11 may be either floor or ground supported and supported thereon are a pair of horizontally extending spaced apart beams 12. The horizontal beams 12 may be welded, brazed or otherwise secured to the I-beams 11 so as to form a rigid structure for supporting a vehicle frame supporting framework indicated generally at 13 in FIG. 1 of the drawings.

The framework 13 comprises a pair of spaced apart parallely extending channel irons or the like 14, each having a series of slots 15 formed in the side walls of the channel irons 14 for a purpose to be described more fully hereinafter. Mounted on a suitable framework 16 extending between the horizontally extending beams 12 is a cylindrical drum 17 to which is welded or otherwise secured the channel irons 14. The drum is mounted for rotation on a vertical shaft 18 provided on the framework 16 for the aforesaid drum. A flange 19 extends along the lower edge of the drum 17 and a plurality of slots 20 are formed therein for receiving therein a locking arm 21 for locking the drum against rotational movement once the drum and framework 13 secured thereto has been rotated to the desired position. A pull cord or the like 22 extends from a spring biased lever arrangement 23 pivotally mounted on the framework 16 and a tie rod 24 extends from one end of the lever 23 to the locking arm 21. Thus, when it is desired to rotate the drum 17 and associated framework 13 so as to properly position the framework 13 with respect to a pulling force which is to be applied to a bent vehicle frame mounted on the framework 13, a pull on the pull cord 22 will retract the locking arm 21 from within one of the aforesaid slots 20 and following the rotation of the drum 17 and associated framework 13 to the desired position, release of the pull cord will cause said spring biased lever arrangement to cause the locking arm to enter into one of the slots 20 to thus lock the drum 17 and framework 13 from further rotation.

The framework 13 comprises a plurality of flat steel plates 25 extending parallel to but spaced from one another as shown more clearly in FIG. 1 of the drawings. The plates 25 are welded or otherwise secured to the channel irons 14 forming the framework shown generally at 13. Transfer beams 26 extend between the channel irons 14 and are secured in adjusted position between the said channel irons 14 by means of the slots 15 formed therein which receive the outer ends of the aforesaid transfer beams. A plurality of openings 27 are formed in the transfer beams and a pin or the like is employed for securing a generally vertically extending brace arm 28 to said transfer beam which is also provided with a plurality of openings 29. A chain or the like 30 having suitable anchors formed at either ends thereof extend from the brace arm to which it is anchored to the area between the plates 25 and anchored therein for retaining the brace arm in adjusted position on the framework 13. As shown in FIG. 1 of the drawings, a plurality of such transfer arms are mounted on said transfer beams so that the frame to be straightened may be engaged by said brace arms at a plurality of points to insure the retaining of the bent frame on the framework 13 when a pulling force is applied thereto during the straightening operation.

Shown in FIG. 1 of the drawings is a vehicle frame 31 of known construction. The frame 31 having a portion thereof to be straightened is placed on the framework 14 and the brace arms 28 are adjusted with respect to the frame and when the brace arms are in their proper position against the vehicle frame the same are locked in place by the chains 30 in the manner aforesaid.

The pulling force for straightening a bent vehicle frame is derived from a hydraulic or pneumatic cylinder which is mounted on a vertical standard 32 which extends between a pair of vertically disposed side frame members 33 which are welded or otherwise secured to a pair of horizontally extending beams 34 to form a tower assembly for the motive power supplying the pulling forces for the apparatus. As can be appreciated, the side frame members 33 are welded or otherwise secured to the horizontal beams 12 in order to provide a rigid structure for the tower assembly. Shown in the drawing at FIG. 1 are a pair of such vertical standards 32 but it should be understood the tower may have more such standards or, for that matter, the tower can have but one such vertical standard and still function in its intended manner.

Mounted for travel on said vertical standards 32 are a pair of connector arms 35, each provided with a chain locking plate 36. As stated previously, the motive power sources may be either hydraulic or pneumatic. A suitable motor and pump assembly shown generally at 37 is secured in any known manner to one of the side frame members 33 and flow lines 38 extend to and from the pump assembly to the cylinder 39 which is secured in any known manner to the vertical standard 32. As can be appreciated each vertical standard will be provided with a cylinder 39. Extending between the vertical standards 32 and a pair of parallely disposed spaced apart roller carrying plates 40 are a plurality of connector straps 41. Extending above the upper horizontal frame member 34 is also a pair of connector plates 42 which are secured in any known manner to the vertical standards 32 and to the roller carrying plates 40. Thus it will be seen that the vertical standards 32 and the roller carrying plates 40 are interconnected. As stated previously, the vertical standards 32 and cylinders 39 affixed thereto along with the roller carrying plates 40 are capable of being moved laterally along the horizontal frame members 34 so as to enable the operator of the apparatus to apply the pulling forces in proper alignment with the section of the frame to be straightened.

Fixed in any known manner on the upper and lower horizontal members 34 shown more particularly in FIG. 5, are equally spaced apart tabs 43 between which the vertical standards are adapted to be nested and held from lateral movement along the horizontal frame members 34 when the motive power source is activated to realign a bent portion of a frame member 31. As shown more clearly in FIG. 4 of the drawings, a plurality of openings 44 are formed in each pair of roller carrying plates 40 and a roller 45 of known construction is held between the aforesaid roller carrying plates 40 by means of a removable pin 46 extending through the openings 44 and a central bore extending through the roller 45. As can be appreciated, the roller 45 may be adjusted to varying height adjustment on the roller carrying plates 40 merely be removing the pin 46 and placing the roller in the area where the same will be most efficient to accomplish the desired angle of pull on the bent frame. Secured to the locking plate 36 is a chain or like member 47 and is then trained over pulleys 48, 49 mounted in suitable bearings between the connector plates 42. Thence the chain extends between the roller carrying plates 40 and then trained over a roller 45 mounted therebetween. A hook or anchor 50 is secured to the free end of the chain for engagement with a portion of a bent frame.

Operation of the equipment is as follows. A bent frame is placed on the framework and by means of the brace arms the same is held thereon in the desired position. If the side of the frame has to be straightened, the drum and framework secured thereto are rotated so that the side of the frame will be facing the tower assembly and when this has been accomplished the vertical standards, cylinder mounted thereon and the roller carrying plates are moved as one body along the horizontal frame member to thus position the same in alignment with the portion of the frame to be straightened. The chain hook or anchor is then applied to that section of the frame to be straightened and then the motive power is activated to activate the cylinder to apply a pulling force on the chain to thus pull on the bent portion of the frame to effect a straightening thereof. By varying the position of the roller 45 in the roller carrying plates, an upward or a downward pull can be exerted on the frame. Also, if a combined upward or downward force coupled with a side pulling force is necessary to effect the straightening of the bent portion of the frame, the standards 32 may be so positioned in the tower assembly as to effect a side pulling on the frame. Of course, the position of the bend frame on the framework can be adjusted relative to the pulling forces by rotating the drum and locking the same in the adjusted position.

While the invention has been described particularly with straightening vehicle frames it is submitted the equipment of the present invention can also be successfully employed in straightening other parts of a vehicle, or for that matter, any bent metallic object can be straightened the only requirement being that the same can be effectively secured to the framework.

While a preferred embodiment of the present invention has been described hereinabove, it is intended that all matter contained in the above description and shown in the accompanying drawings be interpreted as illustrated and not in a limiting sense and that all modifications, constructions and arrangements which fall within the scope and spirit of the invention may be made.

We claim:

1. A frame and body straightening apparatus comprising a vehicle supporting framework, said framework thereagainst a pair of spaced apart horizontally extending beams secured to a pair of transversely extending beams forming a base for the said framework, a rotatable drum positioned between said base and said horizontally spaced apart beams, a pair of parallely spaced apart channel irons secured to said drum for rotation therewith, transfer beams extending between said spaced apart channel irons and being adjustably secured thereto, brace arms adjustably secured to said transfer beams adapted to engage with a portion of a vehicle body positioned on said framework and to retain the same thereon when a pulling force is applied there against to effect a straightening of a bent portion of a vehicle frame, a tower fixedly mounted at one end of said horizontally extending beams, said tower comprising upper and lower horizontally extending beams and vertically disposed beams said horizontally extending beams of the tower and said vertically disposed beams of the tower are fixed to one another and to said horizontally extending beams secured to said base to form a rigid unit, a laterally adjustable vertical standard mounted on said tower, a plurality of spaced apart tabs provided on said upper and lower horizontally extending beams of said tower, said vertical standard including a first pair of spaced apart roller carrying plates and a power cylinder, a power source secured to said cylinder, a first roller means mounted at the upper portion of said vertical standard between said spaced apart roller carrying plates, a second roller means adjustably mounted between a second set of spaced apart roller carrying plates fixed to the said standard, a tie means, one end of said tie means secured to said cylinder and trained to travel over the said first roller means and under the second roller means, the other end of said tie means engaging a portion of said vehicle body to be straightened, said vertical standard nesting between said spaced apart tabs on said upper and lower horizontally extending beams of the said tower to prevent lateral movement of the said standard when said cylinder is actuated to exert a pulling force on a portion of said vehicle body to effect a straightening of a bent portion of said vehicle body mounted on said framework.

2. The structure recited in claim 1 wherein a plurality of openings are provided in said second set of spaced apart roller carrying plates whereby the said second roller means is adjustably mounted therebetween.

3. The structure recited in claim 1 wherein said rotary drum is provided with a slotted flange and a locking arm engaging with a slot in said flange to prevent rotation of the said drum.

* * * * *